US009021648B1

(12) United States Patent
Chu

(10) Patent No.: US 9,021,648 B1
(45) Date of Patent: May 5, 2015

(54) STRENGTH-SAVING SPIRAL MOP POLE

(71) Applicant: Maxplus Industries Company Limited, Shanghai (CN)

(72) Inventor: Chin-Chiung Chu, Shanghai (CN)

(73) Assignee: Maxplus Industries Company Limited, Shanghai (CN)

( * ) Notice: Subject to any disclaimer, the term of this patent is extended or adjusted under 35 U.S.C. 154(b) by 0 days.

(21) Appl. No.: 14/280,382

(22) Filed: May 16, 2014

(51) Int. Cl.

| | |
|---|---|
| ***A47L 13/14*** | (2006.01) |
| ***A47L 13/142*** | (2006.01) |
| ***B25G 1/00*** | (2006.01) |
| ***A47L 13/24*** | (2006.01) |

(52) U.S. Cl.
CPC ..... *B25G 1/002* (2013.01); *A47L 13/24* (2013.01); *A47L 13/14* (2013.01); *A47L 13/142* (2013.01)

(58) Field of Classification Search
CPC ..... A47L 13/14; A47L 13/142
USPC ..... 15/260; 34/58
See application file for complete search history.

(56) References Cited

U.S. PATENT DOCUMENTS 8,739,347 B2 * 6/2014 Lin ..... 15/119.1

FOREIGN PATENT DOCUMENTS

EP 2 387 934 * 11/2011

* cited by examiner

*Primary Examiner* — Randall Chin
(74) *Attorney, Agent, or Firm* — Pai Patent & Trademark Law Firm; Chao-Chang David Pai

(57) ABSTRACT

A strength saving spiral mop pole has a gripping rod, an outer rod, an inner rod, a rotating module and a holding device. The outer rod is mounted in the gripping rod and has a receiving space and a spiral concave portion. The rotating module has a pressing block and a threaded block. The pressing block has a guiding rod. The threaded block is penetrated by the guiding rod and attached to the pressing block. The threaded block has multiple spiral protrusive parts engaged with the spiral concave portion. To use the spiral mop pole of the present invention, the outer rod is pressed and the threaded block is rotated in the outer rod. The pressing block and the inner rod are driven by the threaded block so that the spinning removal of water is achieved by the rotation.

7 Claims, 8 Drawing Sheets

STRENGTH-SAVING SPIRAL MOP POLE

BACKGROUND OF THE INVENTION

1. Field of the Invention

The present invention is a mop pole, especially a strength saving spiral mop pole that rotates when pressed.

2. Description of the Prior Arts

Mop is an ordinary cleaning tool in daily life. The mop has a pole, a mop head and cotton ropes. The mop head is connected to one end of the pole, and the cotton ropes are mounted on the outer surface of the mop head. The cotton ropes can be used to clean away dirt when absorbing water. The wet cotton ropes are strained and twisted by hands to remove surplus water, but the straining and twisting is laborious.

A conventional rotating mop was developed for improving the shortcoming of being too laborious. The mop head is pivoted around one end of the pole. The rotating mop is operated with a spin tub. The spin tub has a container and a driving mechanism, and the container is pivoted in the spin tub and connected to the driving mechanism. To remove surplus water from the wet cotton ropes, the mop head and the cotton ropes are put in the container. The driving mechanism is trodden on by a user to rotate the container. The surplus water is removed from the wet cotton ropes by means of rotating the spin container.

The conventional rotating mop is operated with a spin tub mounted with a driving mechanism. The spin tub has complicated structure that causes high production cost. The spin tub is heavy and the capacity of collecting water is low due to the driving mechanism mounted therein. Besides, it is inconvenient to hold the rotating mop and tread on the driving mechanism at the same time in the spinning process.

To overcome the shortcomings, the present invention provides a strength saving spiral mop pole to mitigate or obviate the aforementioned problems.

SUMMARY OF THE INVENTION

The main objective of the present invention is to provide a strength saving spiral mop pole that is rotatable by pressing. The present invention can be operated easily by users and produced with low cost due to the simplified structure.

The strength saving spiral mop pole comprises a gripping rod that is hollow. An outer rod is mounted in the gripping rod and has a receiving space and a spiral concave portion. The receiving space is formed inside of the outer rod. The spiral concave portion is formed in the outer rod. An inner rod is mounted in the receiving space of the outer rod and has an installation hole. The installation hole is formed on the inner rod. A rotating module is connected to the inner rod and has a pressing block and a threaded block. The pressing block is mounted in the installation hole and has a guiding rod. The threaded block is penetrated by the guiding rod and fastened to the pressing block, and has multiple spiral protrusive parts formed on the threaded block. The spiral protrusive parts are fastened together by screws with the spiral concave portion. A holding device is mounted on the inner rod.

The threaded block can be rotated in the receiving space while pressing the outer rod. The inner rod is driven by the threaded block and rotating as well. In actual use, a mop head and cotton ropes are mounted to the inner rod. The cotton ropes are used to absorb water. The mop head and the cotton ropes are put into an ordinary spin tub and then the outer rod is pressed for water removal. After the water removal, the inner rod is held in position by the holding device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
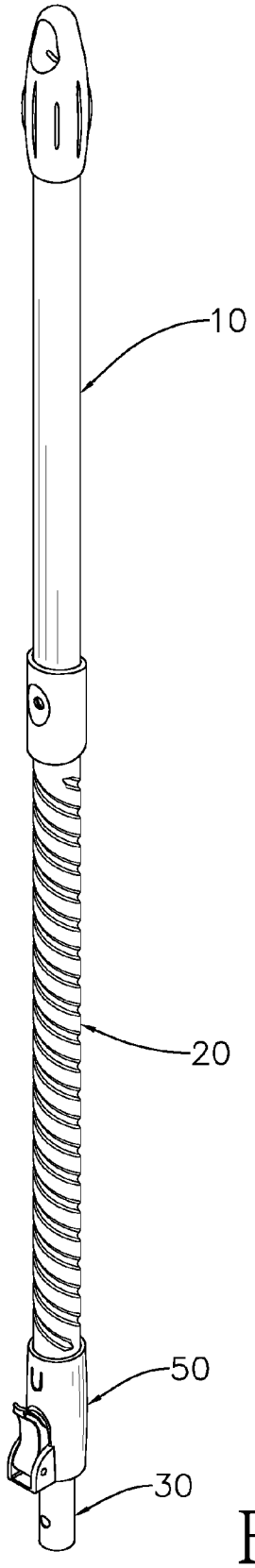
FIG. 1 is a perspective view of a strength saving spiral mop pole in accordance with the present invention.

With reference to FIG. 1, a strength-saving spiral mop pole in accordance with the present invention comprises a gripping rod 10, an outer rod 20, an inner rod 30, a rotating module 40 and a holding device 50.

Figure 2:
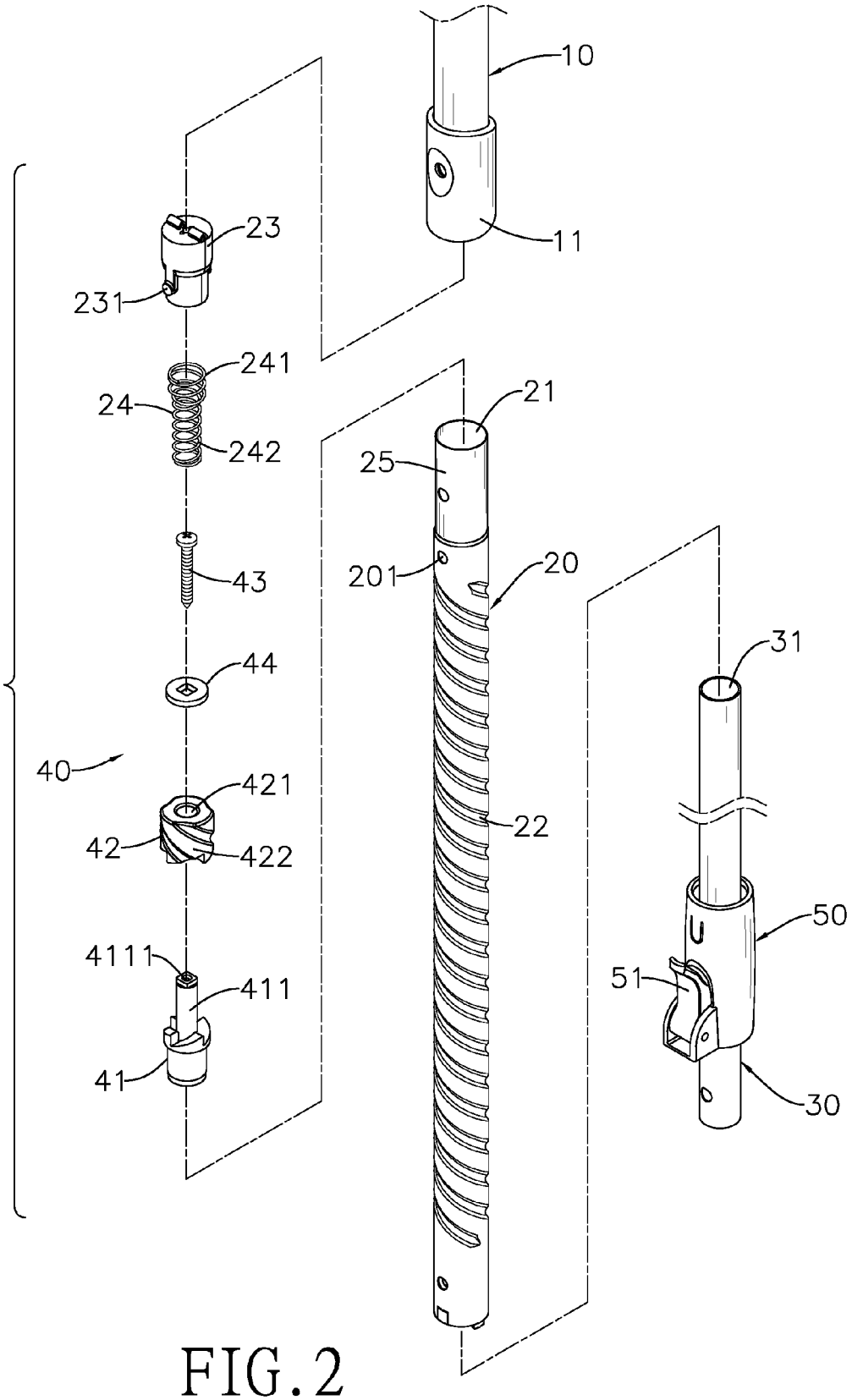
FIG. 2 is an exploded perspective view of the strength saving spiral mop pole in FIG. 1.

With reference to FIGS. 1 and 2, the gripping rod 10 is hollow and has a connecting unit 11. The connecting unit 11 is mounted on the gripping rod 10.

Figure 3:
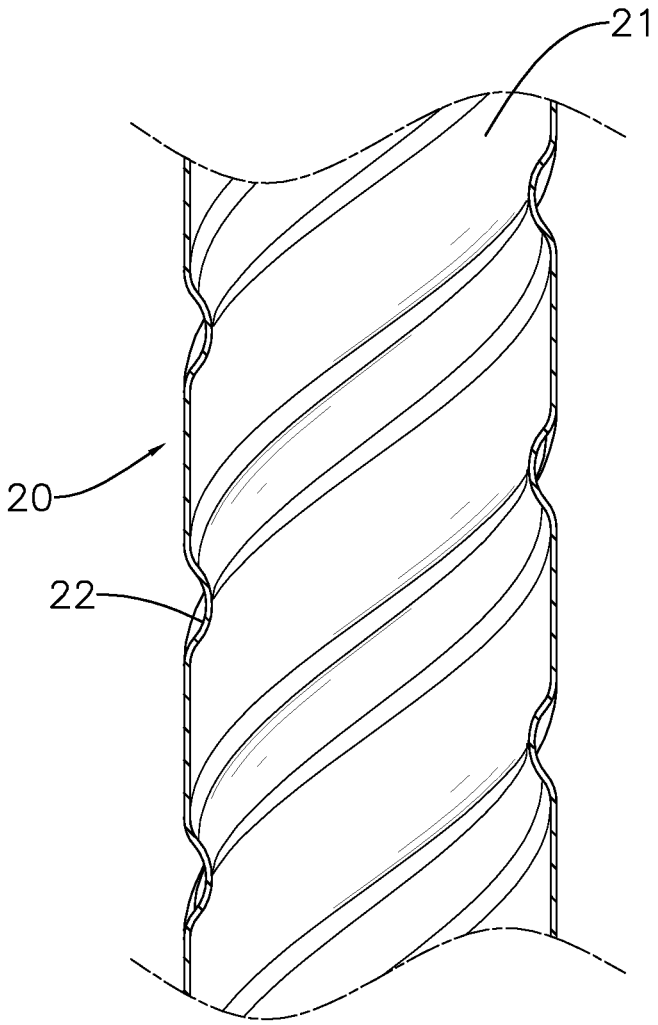
FIG. 3 is an enlarged partially cross-sectional side view of an outer rod of the strength saving spiral mop pole in FIG. 1.
Figure 7:
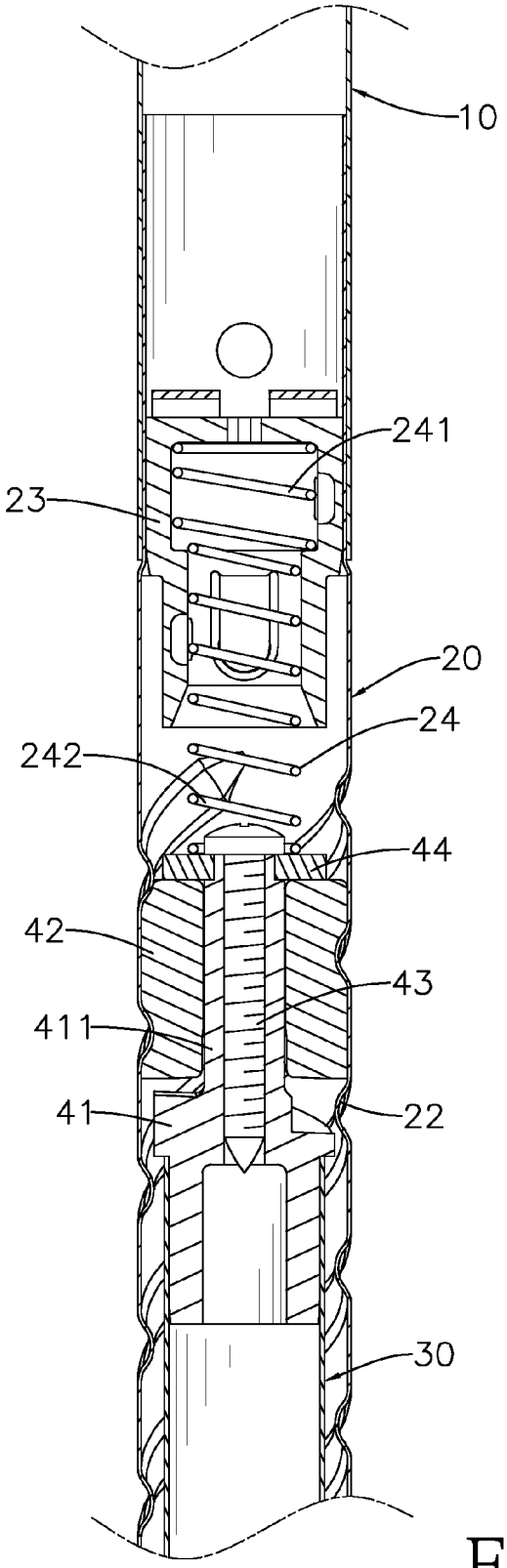
FIG. 7 is an enlarged partially cross-sectional side view of the strength saving spiral mop pole in FIG. 1.

With reference to FIGS. 2, 3 and 7, the outer rod 20 is mounted partially in the gripping rod 10 and has a receiving space 21, two fastening holes 201, a spiral concave portion 22, a cap 23, a spring 24 and a fastening part 25. The receiving space 21 is formed in the outer rod 20 and the outer rod 20 has two opening ends. The two fastening holes 201 are formed opposite each other on the outer rod 20 and are connected to the receiving space 21. The spiral concave portion 22 is formed helically in the outer rod 20 and is away from the opening ends of the outer rod 20. The cap 23 is mounted in the receiving space 21 and has two lumps 231. The two lumps 231 are formed opposite each other on the cap 23 and are fastened respectively to the two fastening holes 201. The spring 24 has a linking end 241 and a buffering end 242. The linking end 241 has a diameter larger than a diameter of the buffering end 242. The linking end 241 is fastened in the cap 23 and the buffering end 242 extends outside of the cap 23. The fastening part 25 is formed on one of the opening ends of the outer rod 20 and is located above the fastening holes 201. The fastening part 25 is mounted in the gripping rod 10 and is held in position by the connecting unit 11.

With reference to FIGS. 2 and 7, the inner rod 30 is mounted in the receiving space 21 of the outer rod 20 and has an installation hole 31. The installation hole 31 is formed on the inner rod 30.

Figure 4:
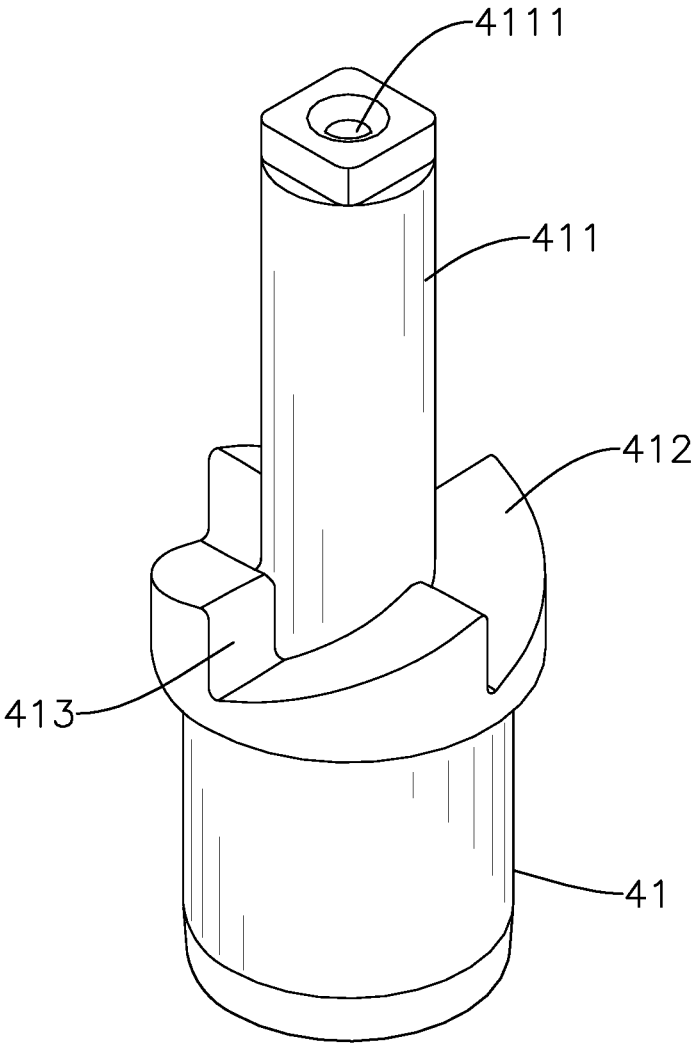
FIG. 4 is a perspective view of a pressing block of the strength saving spiral mop pole in FIG. 1.
Figure 6:
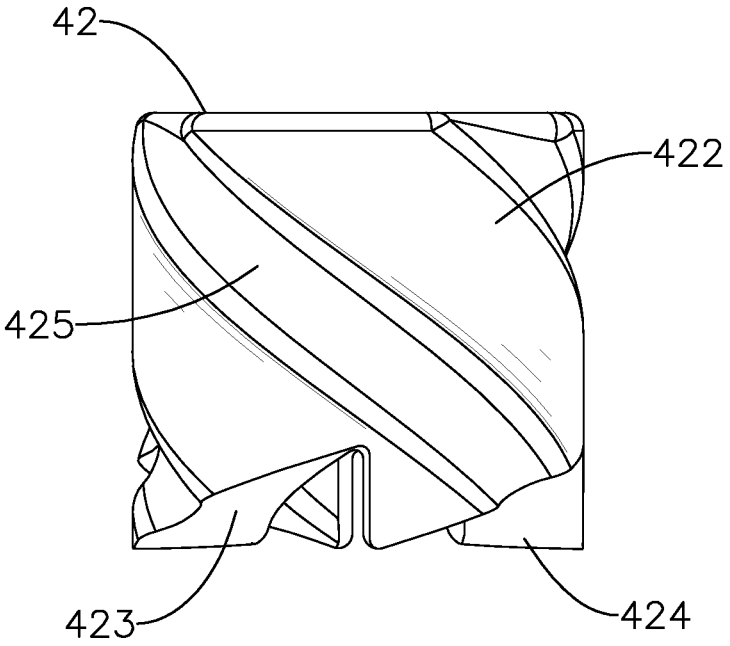
FIG. 6 is a side view of the threaded block of the strength saving spiral mop pole in FIG. 1.

With reference to FIGS. 2 and 4, the rotating module 40 is connected to the inner rod 30 and has a pressing block 41, a threaded block 42, a stationary component 43 and a gasket 44. The pressing block 41 is mounted through the installation hole 31 and is surrounded by the outer rod 20. With reference to FIG. 6, the pressing block 41 has a guiding rod 411, four abutting surfaces 412 and four pushing surfaces 413. The guiding rod 411 is formed and extends perpendicularly on the pressing block 41, and the guiding rod 411 has a lock hole 4111 formed on the guiding rod 411. The abutting surfaces 412 and the pushing surfaces 413 are formed on the guiding rod 411. Each abutting surface 412 is clamped between the adjacent pushing surfaces 413 and at an acute angle with respect to the pushing surfaces 413.

Figure 5:
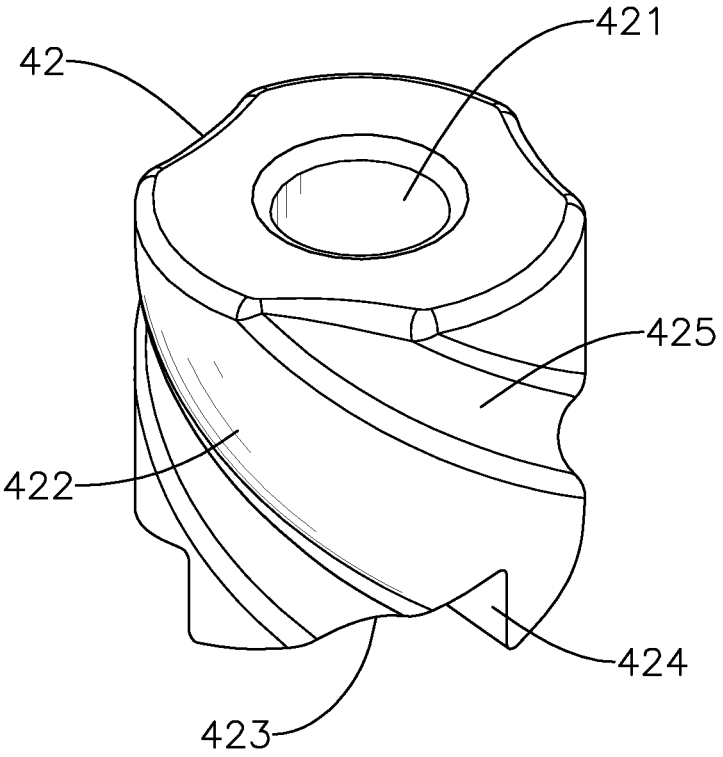
FIG. 5 is a perspective view of a threaded block of the strength saving spiral mop pole in FIG. 1.

With reference to FIGS. 5 and 6, the threaded block 42 is fastened with the pressing block 41 and has a through hole 421, multiple spiral protrusive parts 422, four abutted surfaces 423, four pushed surfaces 424 and multiple oblique grooves 425. The through hole 421 is formed through the threaded block 42. The guiding rod 411 of the pressing block 41 is mounted through the through hole 421. The spiral protrusive parts 422 are formed obliquely on the threaded block 42, and the spiral protrusive parts 422 are spaced apart from one another. The oblique grooves 425 are formed between the spiral protrusive parts 422. The spiral concave portion 22 is engaged with the spiral protrusive parts 422 and the oblique grooves 425. The abutted surfaces 423 and the pushed surfaces 424 are formed on the bottom side of the threaded block 42, and are attached respectively to the corresponding abutting surfaces 412 and pushing surfaces 413.

The stationary component 43 is mounted through the through hole 421 and is mounted securely in the lock hole 4111 of the guiding rod 411. The gasket 44 is mounted on the threaded block 42, is penetrated by the stationary component 43, and is pressed by the buffering end 242 of the spring 24.

With reference to FIGS. 1 and 2, the holding device 50 is mounted on the inner rod 30 and surrounds the outer rod 20. The holding device 50 is distal from the gripping rod 10 and has a clamping component 51 mounted pivotally on the holding device 50. The clamping component 51 is used for limiting the rotation of the inner rod 30.

Figure 8:
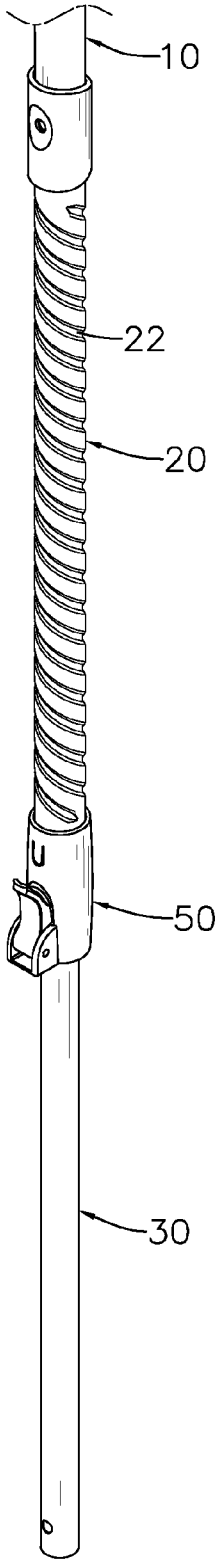
FIG. 8 is an operational perspective view of the strength saving spiral mop pole in FIG. 1.

With reference to FIGS. 1, 7 and 8, in actual use of the present invention, a mop head and cotton ropes are mounted to the inner rod 30, and then are operated with an ordinary spin tub having a container. The mop head and cotton ropes are put in the container after absorbing water. The gripping rod 10 is pressed so that the threaded block 42 is rotated in the outer rod 20. Furthermore, the inner rod 30 connecting to the pressing block 41 is driven by the threaded block 42. In the spinning process, the outer rod 20 moves straightly along the spiral concave portion 22 at the same time. When the outer rod 20 moves down to the bottom side, the gasket 44 is pressed by the buffering end 242 of the spring 24 and then dragging the gripping rod 10 to an opposite direction, and the threaded block 42 is separated from the pressing block 41. The inner rod 30 moves straightly without rotating. The above action that makes the inner rod 30 rotate in only one direction is repeated when the outer rod 20 moves to the top side. So the spinning removal of water is achieved by the rotating of the outer rod 30.

The strength saving spiral mop pole of the present invention could be operated with an ordinary water container rather than a conventional spin tub having a driving mechanism. So the present invention could be used easily and produced with low cost.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A strength saving spiral mop pole comprising:

a gripping rod being a hollow rod body;

an outer rod mounted in the gripping rod and having two opening ends, a receiving space and a spiral concave portion, the receiving space formed inside of the outer rod, and the spiral concave portion formed helically in the outer rod;

an inner rod mounted in the receiving space and having an installation hole formed on one end of the inner rod;

a rotating module connected to the inner rod and having a pressing block and a threaded block, the pressing block mounted in the installation hole and having a guiding rod, four abutting surfaces and four pushing surfaces, the guiding rod extending perpendicularly on the pressing block, the abutting surfaces and the pushing surfaces formed on the guiding rod, the threaded block penetrated by the guiding rod and fastened to the pressing block, the threaded block having multiple spiral protrusive parts formed on the threaded block, four abutted surfaces and four pushed surfaces, and the spiral protrusive parts screwed together with the spiral concave portion, the abutted surfaces and the pushed surfaces of the threaded block mounted on a bottom side of the threaded block, and the abutted surfaces and the pushed surfaces attached respectively to the abutting surfaces and the pushing surfaces of the pressing block; and a holding device mounted on the exterior wall of the inner rod, surrounding the outer rod, being distal from the gripping rod, and having a clamping component mounted pivotally on the holding device.

2. The strength saving spiral mop pole as claimed in claim 1, wherein the threaded block has multiple oblique grooves, the spiral protrusive parts are formed obliquely on the threaded block and spaced apart from one another, the multiple oblique grooves are formed between the spiral protrusive parts, and the spiral concave portion is screwed together with the spiral protrusive parts and the oblique grooves.

3. The strength saving spiral mop pole as claimed in claim 2, wherein the gripping rod has a connecting unit, the connecting unit is mounted on one end of the gripping rod, the outer rod has two fastening holes, a cap, a spring and a fastening part, the two fastening holes are formed opposite each other on the outer rod, the spiral concave portion is away from the two opening ends of the outer rod, the cap is mounted in the receiving space and has two lumps, the two lumps are formed opposite each other on the cap and fastened respectively to the two fastening holes, the spring is mounted in the cap, and the fastening part is formed on one of the opening ends of the outer rod and located above the fastening holes, and the fastening part is mounted in the gripping rod and held in position by the connecting unit.

4. The strength saving spiral mop pole as claimed in claim 3, wherein the guiding rod has a lock hole formed on the guiding rod, each abutting surface is clamped between the adjacent pushing surfaces and at an acute angle with respect to the pushing surfaces, the threaded block has a through hole, the through hole is formed through the threaded block, and the guiding rod is mounted in the through hole.

5. The strength saving spiral mop pole as claimed in claim 4, wherein the spring has a linking end and a buffering end, the linking end has a diameter larger than a diameter of the buffering end, the linking end is fastened in the cap and the buffering end extends outside of the cap, the rotating module has a stationary component and a gasket, the stationary component is mounted through the through hole and is mounted securely in the lock hole, and the gasket is mounted on the threaded block, is penetrated by the stationary component, and is pressed by the buffering end of the spring.

6. The strength saving spiral mop pole as claimed in claim 2, wherein the outer rod has a cap and a spring, the cap is mounted in the receiving space, and the spring is mounted in the cap;

the guiding rod has a lock hole formed on the guiding rod, each abutting surface is clamped between the adjacent pushing surfaces and at an acute angle with respect to the pushing surfaces, the threaded block has a through hole, the through hole is formed through the threaded block, and the guiding rod is mounted in the through hole.

7. The strength saving spiral mop pole as claimed in claim 6, wherein the spring has a linking end and a buffering end, the linking end has a diameter larger than a diameter of the buffering end, the linking end is fastened in the cap and the buffering end extends outside of the cap, the rotating module has a stationary component and a gasket, the stationary component is mounted through the through hole and is mounted securely in the lock hole, and the gasket is mounted on the threaded block, is penetrated by the stationary component, and is pressed by the buffering end of the spring.

* * * * *